United States Patent [19]

Beltramini

[11] Patent Number: 4,777,122

[45] Date of Patent: Oct. 11, 1988

[54] SILVER HALIDE MULTILAYER COLOR PHOTOGRAPHIC MATERIAL CONTAINING COUPLERS HAVING DIFFERENT COUPLING RATES

[75] Inventor: Walter Beltramini, Albisola Superiore, Italy

[73] Assignee: Minnesota Mining and Manufacturing Company, St. Paul, Minn.

[21] Appl. No.: 18,276

[22] Filed: Feb. 24, 1987

[30] Foreign Application Priority Data

Feb. 24, 1986 [IT] Italy ..... 19519 A/86

[51] Int. Cl.[4] ..... G03C 1/46

[52] U.S. Cl. ..... 430/502; 430/503; 430/505; 430/506; 430/509

[58] Field of Search ..... 430/502, 503, 505, 506, 430/507, 509

[56] References Cited

U.S. PATENT DOCUMENTS

| | | | |
|---|---|---|---|
| 2,640,776 | 6/1953 | Spence et al. | 95/7 |
| 3,450,536 | 6/1969 | Wyckoff | 96/68 |
| 3,843,369 | 10/1974 | Kumai et al. | 96/74 |
| 4,370,410 | 1/1983 | Iijima et al. | 430/505 |

FOREIGN PATENT DOCUMENTS

| | | | |
|---|---|---|---|
| 818687 | 8/1959 | United Kingdom . | |
| 923045 | 4/1963 | United Kingdom . | |
| 1500497 | 7/1975 | United Kingdom | 430/506 |
| 1576991 | 10/1980 | United Kingdom . | |

*Primary Examiner*—Paul R. Michl
*Assistant Examiner*—Patrick A. Doody
*Attorney, Agent, or Firm*—Donald M. Sell; Mark A. Litman

[57] ABSTRACT

A high sensitivity multilayer color photographic material is disclosed. The material is comprised of a support base having coated thereon red-sensitive, green-sensitive and blue-sensitive silver halide emulsion layers associated with non-diffusing image-forming couplers. The red-sensitive silver halide emulsion layer comprises an upper, an intermediate and a lower silver halide emulsion layer, sensitive to visible light in the same or substantially the same spectral wavelength range, with the sensitivity of the layers decreasing in order from the upper layer to the lower layer. The green-sensitive silver halide emulsion layer comprises an upper and a lower silver halide emulsion layer, sensitive to visible light in about the same spectral wavelength range, with the sensitivity of the layers decreasing in order from the upper layer to the lower layer. The most sensitive red-sensitive silver halide emulsion layer is arranged between the less senitive and the more sensitive green-sensitive silver halide emulsion layers. The most sensitive red-sensitive silver halide emulsion layer comprises at least one non-diffusing cyan coupler and the more sensitive green-sensitive silver halide emulsion layer comprises at least one non-diffusing magenta coupler, relative coupling rates of said cyan and magenta couplers being higher than couplers forming the same color in the respective layers of lower same-wave-length sensitivity.

20 Claims, No Drawings

SILVER HALIDE MULTILAYER COLOR PHOTOGRAPHIC MATERIAL CONTAINING COUPLERS HAVING DIFFERENT COUPLING RATES

FIELD OF THE INVENTION

This invention relates to multilayer silver halide color photographic materials and more particularly to high-speed silver halide color photographic materials comprising red-sensitive silver halide emulsion layers, green-sensitive silver halide emulsion layers and blue-sensitive silver halide emulsion layers.

BACKGROUND OF THE ART

It is known to produce colored photographic images by means of multilayer silver halide materials comprising a support having coated thereon a red-sensitive, a green-sensitive and a blue-sensitive silver halide emulsion layer, each of said silver halide emulsion layers having associated therewith non-diffusing color couplers for the production, respectively, of the cyan, magenta and yellow images. Usually, color photographic materials also contain other layers, for example a yellow filter layer, an anti-halation layer, intermediate layers and protective layers.

It is also known to produce colored photographic images by using multilayer materials in which at least two silver halide emulsion layers are respectively provided for producing one or more of the three different color images. British Pat. No. 818,687 suggests increasing the sensitivity of a multilayer color material by using at least one emulsion layer which comprises two component silver halide emulsion layers (hemi-layers) sensitized to the same spectral region, of which the upper component layer (most sensitive layer) has a sensitivity higher than that of the bottom layer (least sensitive layer). British Pat. No. 923,045 suggests the use of double layers of different sensitivity, of which the more sensitive layer produces the lower color density during color development. In this way, it is possible to increase sensitivity without at the same time adversely affecting graininess.

U.S. Pat. No. 3,843,369 discloses how the graininess of a color image can be improved by using three different silver halide emulsion component layers having the same spectral sensitivity, but different general sensitivity decreasing in the order from the upper (most sensitive) component emulsion layer to the intermediate (medium sensitivity) component emulsion layer and to the bottom (least sensitive) component emulsion layer. It is preferred that, in the intermediate and upper component layer, a maximum color density of at most 0.6 is obtained. The maximum color density may be controlled for instance by reducing the coupler content, i.e. by increasing the silver halide to coupler ratio. In higher sensitive color negative materials, triple layers are particularly useful for forming the magenta color image, owing to the fact that the sensitivity of the human eye is the highest in the green spectral region, so that the graininess of the magenta color image is most noticeable.

Finally, British Pat. No. 1,576,991 discloses a color photographic material in which the more sensitive component layer of a double red-sensitive silver halide emulsion layer is arranged between two component layers of a triple green-sensitive silver halide layer. In comparison with a color photographic material of U.S. Pat. No. 3,843,369 (comprising, in order, two red-sensitive silver halide emulsion layers of different sensitivities and three green-sensitive silver halide emulsion layers of different sensitivities. No layer of one color sensitivity is between two silver halide layers having the same second color sensitivity.) color photographic material of British Pat. No. 1,576,991 provides a higher sensitivity of the cyan image with substantially the same color graininess, without increasing the sensitivity of the other image layers.

Despite the numerous efforts made, there is still the need to find special layer arrangements in color photographic materials to obtain the extremely high sensitive photographic elements required by the photographic market.

SUMMARY OF THE INVENTION

According to the present invention, a highly sensitive color photographic material for producing multicolor images, comprising red-sensitive, green-sensitive and blue-sensitive silver halide emulsion layers associated with non-diffusing image-forming couplers, is obtained when the most sensitive component layer of the three red-sensitive silver halide emulsion layers of different sensitivity is arranged between less sensitive and more sensitive component green-sensitive silver halide emulsion layers and the most sensitive red-sensitive silver halide emulsion layer comprises at least one non-diffusing cyan coupler and the more sensitive green-sensitive silver halide emulsion layer comprises at least a non-diffusing magenta coupler, said cyan and magenta couplers having relative coupling rates higher than relative coupling rates of couplers forming the same color in the respective layers of lower same-wavelength sensitivity.

According to the invention, higher sensitivities of each of the cyan, magenta and yellow image layers are obtained without thereby substantially adversely affecting the graininess of the color image.

DETAILED DESCRIPTION OF THE INVENTION

The present invention relates to a multilayer color photographic material for producing multicolor images, comprising a support having coated thereon a plurality of light-sensitive and non-light-sensitive layers including:

(a) at least three red-sensitive silver halide emulsion layers, the sensitivities of which increase in the order from the lower to the upper layer;

(b) at least two green-sensitive silver halide emulsion layers, the sensitivities of which increase from the lower to the upper layer; and (c) at least one blue-sensitive silver halide emulsion layer, said silver halide emulsion layers being associated with non-diffusing image-forming couplers, in which the most sensitive red-sensitive silver halide emulsion layer is between the less sensitive and the more sensitive green-sensitive silver halide emulsion layers, the most sensitive red-sensitive silver halide emulsion layer contains at least one non-diffusing cyan coupler and the more sensitive green-sensitive silver halide emulsion layer contains at least one non-diffusing magenta coupler, said cyan and magenta couplers having relative coupling rates higher than couplers forming the same color in the respective layers of lower same-wavelength sensitivity.

As used herein, the terms "upper", "intermediate" and "lower" are with respect to incident light of exposure, upper surface or layer being closest to the incident light of exposure.

In one preferred embodiment, the present invention relates to a color photographic material comprising, coated on a preferably transparent support, the following layers in the indicated order (from the bottom upwards):

(a) a least sensitive red-sensitive silver halide emulsion layer containing a cyan coupler;

(b) a medium sensitivity red-sensitive silver halide emulsion layer containing a cyan coupler;

(c) a less sensitive green-sensitive silver halide emulsion layer containing a magenta coupler;

(d) a most sensitive red-sensitive silver halide emulsion layer containing a cyan coupler;

(e) a more sensitive green-sensitive silver halide emulsion layer containing a magenta coupler;

(f) a yellow filter layer;

(g) a less sensitive blue-sensitive silver halide emulsion layer containing a yellow coupler;

(h) a more sensitive blue-sensitive silver halide emulsion layer containing a yellow coupler, wherein the most sensitive red-sensitive silver halide emulsion layer comprises at least one non-diffusing cyan coupler and/or the more sensitive green-sensitive silver halide emulsion layer comprises at least one non-diffusing magenta coupler, relative coupling rates of said cyan and magenta couplers being higher than relative coupling rates of couplers forming the same color in the respective layers of lower same-wavelength sensitivity.

In addition to the layers described above, other non-light-sensitive auxiliary layers may be present in the color photographic material of this invention, such as for example subbing layers, antihalation layers or protective layers, or intermediate layers between the light-sensitive layers, which are used for preventing developer oxidation products from diffusing from one layer into another layer. Such intermediate layers may also contain compounds which are capable of reacting with the developer oxidation products. Such intermediate layers are preferably arranged between adjacent light-sensitive layers of different spectral sensitivity. In particular, a silver halide emulsion layer of comparatively very low sensitivity, preferably a silver bromo-iodide emulsion having no more than 4% silver iodide moles and a mean grain diameter of approximately 0.1 micron or less (a Lippmann emulsion, as defined in "The Theory Of The Photographic Process", 3rd edition, 1966, page 369, published by Collier MacMillan Ltd.) may be arranged between the most sensitive red-sensitive silver halide emulsion component layer and the more sensitive green-sensitive silver halide emulsion component layer arranged on it; other non-light-sensitive silver halide emulsion layers, even if less preferable, may be coated for example over the blue-sensitive silver halide emulsion layer, between the most sensitive red-sensitive silver halide emulsion layer and the less sensitive green-sensitive silver halide emulsion layer arranged on it or between the less sensitive green-sensitive silver halide emulsion layer and the medium sensitivity red-sensitive silver halide emulsion layers arranged on it. Such layers may have beneficial effects upon the sensitivity of the light-sensitive layers.

According to the present invention, the red-sensitive silver halide emulsion layer is composed of an upper, an intermediate and a lower silver halide emulsion layers, each sensitive to the visible light in the same spectral wavelength region, with the sensitivity of the layers decreasing in order from the upper layer (nearest to the surface of the material to be image-wise exposed) to the lower layer. The sensitivity difference (a) between the upper (most sensitive) and the intermediate (medium sensitivity), (b) between the intermediate (medium sensitivity) and the lower (least sensitive) and (c) between the upper (most sensitive) and the lower (least sensitive) silver halide emulsion layers is in the range from (a) 0.15 to 1.3 log E, from (b) 0.1 to 0.7 log E and from (c) 0.3 to 1.5 log E, respectively (wherein E is the amount of exposure in lux/seconds). Such differences in sensitivity are selected to obtain, on processing, a wide latitude in the photographic element, without any noticeable distortion in the shape of the sensitometric curve. A method for adjusting the required sensitivity includes changing the grain size of the silver halide grains. The mean grain size of the silver halide grains in the emulsions used for upper (most sensitive) and intermediate (medium sensitivity) red-sensitive layers is preferably 1.0 micron or more. The medium sensitivity red-sensitive silver halide emulsion is to have a sensitivity higher than the least sensitive red-sensitive silver halide emulsion and not higher than the most sensitive red-sensitive silver halide emulsion. Said medium sensitivity red-sensitive silver halide emulsion may have the same sensitivity of said most sensitive red-sensitive emulsion layer even if the sensitivity of the layer containing it is lower than that of the layer containing the same emulsion but positioned upper and possibly associated with a coupler having a higher relative coupling rate. The upper red-sensitive emulsion layer is further preferred to be a high-speed silver halide emulsion, wherein more than 10% by weight, and preferably more than 30% of all grains is composed of large grains having a grain size of 2.0 micron or more.

The green-sensitive silver halide emulsion layer is preferably composed of upper and lower silver halide emulsion layers, each sensitive to the visible light in the same spectral wavelength region, with the sensitivity of the layers decreasing from the upper layer (nearest to the side of the material to be image-wise exposed) to the lower layer. The sensitivity difference between the upper (more sensitive) and the lower (less sensitive) silver halide emulsion layer is generally 0.15 to 1.3 log E and, like the sensitivity differences of the red-sensitive silver halide emulsion layers, is selected to obtain, on color development, a wide latitude, without any noticeable distortion in the shape of the sensitometric curve. The method for adjusting the required sensitivity include that described above.

Color couplers capable of reacting with the color developer oxidation products to form non-diffusing dyes are associated with any above mentioned silver halide emulsion layer. Suitable couplers are preferably selected from the couplers having non-diffusing groups, such as groups having a hydrophobic group of about 8 to 32 carbon atoms, introduced into the coupler molecule. Such a group is called "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

In order to introduce the couplers into the silver halide emulsion layer, conventional methods known to the artisan can be employed. According to U.S. Pat.

Nos. 2,322,027; 2,801,170; 2,801,171 and 2,991,177, the couplers can be incorporated into the silver halide emulsion layer according to the dispersion technique, which consists of dissolving the coupler in a water-immiscible organic solvent and then dispersing such a solution in a hydrophilic colloidal binder as vary small droplets. The preferred colloidal binder is gelatin, although other kinds of binders can also be used.

Another way of introduction of the couplers into the silver halide emulsion layer consists of the so-called "loaded-latex technique". A detailed description of such technique can be found in BE Pat. Nos. 853,512 and 869,816; in U.S. Pat. Nos. 4,214,047 and 4,199,363 and in EP Pat. No. 14,921. It consists of mixing a solution of the coupler in a water-miscible organic solvent with a polymeric latex consisting of water, as continuous phase, and polymeric particles having a mean diameter ranging from 0.02 to 0.2 micron, as a dispersed phase.

Another useful method is further the Fisher process. According to such a process, couplers having a water-soluble group, such as a carboxyl, hydroxy, sulfonic or a sulfonamido group, can be added to the photographic layer for example by dissolving them in an alkaline water solution.

Said non-diffusing couplers are introduced into the light-sensitive silver halide emulsion layers or into non-light-sensitive layers adjacent thereto. On color development, said couplers give a color which is complementary to the light color to which the silver halide emulsion layers are sensitive. Consequently, at least one non-diffusing color coupler for producing a cyan image, generally a phenol or an alpha-naphthol compound, is associated with each of the red-sensitive silver halide emulsion layers and at least one non-diffusing color coupler for producing the magenta image, generally a 5-pyrazolone or a pyrazolotriazole compound, is associated with each of the two green-sensitive silver halide emulsion layers.

Said color couplers may be both 4-equivalent and 2-equivalent couplers, the latter requiring a smaller amount of silver halide for color production. Among the 2-equivalent couplers which may be used in the present invention are included both substantially colorless and colored couplers ("masked couplers"); 2-equivalent couplers also include the known white couplers which do not form any dye on reaction with the color developer oxidation products; 2-equivalent color couplers include also the known DIR couplers which are capable of releasing a diffusing development inhibiting compound on reaction with the color developer oxidation products.

Examples of cyan couplers which can be used in the present invention can be selected from those described in U.S. Pat. Nos. 2,369,929; 2,474,293; 3,591,383; 2,895,826; 3,458,315; 3,311,476; 3,419,390; 3,476,563 and 3,253,924; and in British Pat. No. 1,201,110.

Examples of magenta couplers which can be used in the present invention can be selected from those described in U.S. Pat. Nos. 2,600,788; 3,558,319; 3,468,666; 3,419,301; 3,311,476; 3,253,924 and 3,311,476 and in British Pat. Nos. 1,293,640; 1,438,459 and 1,464,361.

Colored cyan couplers which can be used in the present invention can be selected from those described in U.S. Pat. Nos. 3,934,802; 3,386,301 and 2,434,272.

Colored magenta couplers which can be used in the present invention can be selected from the colored magenta couplers described in U.S. Pat. Nos. 2,434,272; 3,476,564 and 3,476,560 and in British Pat. No. 1,464,361.

Colorless couplers which can be used in the present invention can be selected from those described in British Pat. Nos. 861,138; 914,145 and 1,109,963 and in U.S. Pat. No. 3,580,722.

Examples of DIR couplers or DIR coupling compounds which can be used in the present invention include those described in U.S. Pat. Nos. 3,148,062; 3,227,554; 3,617,291; in German patent application Ser. Nos. 2,414,006; 2,659,417; 2,527,652; 2,703,145 and 2,626,315; in Japanese patent application Ser. Nos. 30,591/75 and 82,423/77 and in British Pat. No. 1,153,587.

Examples of non-color forming DIR coupling compounds which can be used in the present invention include those described in U.S. Pat. Nos. 3,938,996; 3,632,345; 3,639,417; 3,297,445 and 3,928,041; in German patent application Ser. Nos. 2,405,442; 2,523,705; 2,460,202; 2,529,350 and 2,448,063; in Japanese patent application Ser. Nos. 143,538/75 and 147,716/75 and in British Pat. Nos. 1,423,588 and 1,542,705.

The color couplers associated with two or component layers having the same spectral sensitivity do not necessarily have to be the same; they are only required to give, on color development, the same color, normally a color complementary to the color of the light to which the associated silver halide emulsion layers are sensitive.

Preferably, at least the less sensitive green-sensitive silver halide emulsion layers contains a diffusion-resistant compound capable of releasing a diffusing development inhibitor on reaction with the color developer oxidation products.

Such development inhibitor releasing compounds are the known DIR couplers or DIR compounds described above, more preferably DIR couplers such as those described in U.S. Pat. Nos. 3,227,554 and 3,615,506.

Still preferably, at least the least sensitive red-sensitive silver halide emulsion layer and the less sensitive green-sensitive silver halide emulsion layer contain 2-equivalent couplers which have an intensive natural color, which is then replaced during coupling by the color of the image dye produced. These are the masked couplers described above, which are used to compensate against the undesired side densities of the image dyes.

The magenta and cyan couplers having a higher coupling rate and a lower coupling rate used in the present invention are normally distinguished on the basis of their relative coupling rates as known in the art.

One method, well-known in the art, for measuring the relative coupling rate is described in "Mitteilungen aus den Forschungslaboratorien der Agfa Leverkusen-München, vol. 3, page 81, Springer Verlag 1961". This method was primary developed to measure the relative coupling rates of water-soluble couplers. By making reference to this method, U.S. Pat. No. 3,726,681 and British Pat. Nos. 1,336,728, 1,513,321 and 1,575,711 describe couplers (both water-soluble and water-insoluble) having different coupling rates.

By following this method, two classes of couplers have been traditionally defined in the art; those having a high coupling rate and those having a low coupling rate, the former having a coupling rate 2 to 20, or 3 to 5, times the coupling rate of the latter.

According to the above classification, examples of preferred couplers having a high coupling rate include the following compounds.
Cyan couplers
C-1.
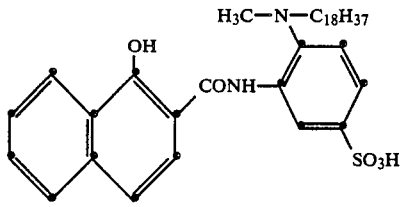
C-2.
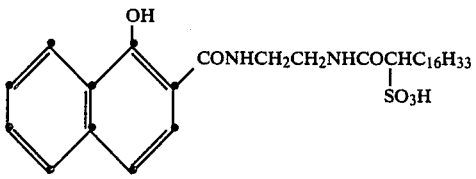
C-3.
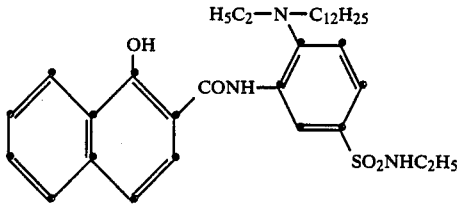
C-4.
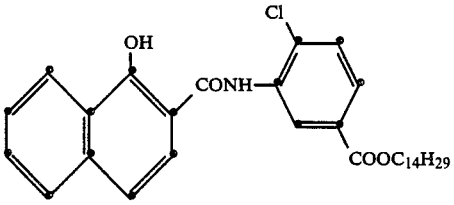
C-5.
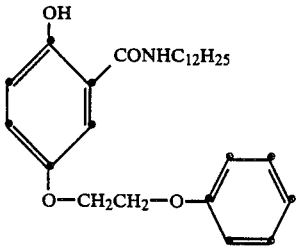
C-6.
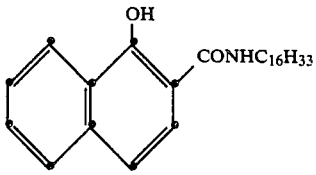
-continued
Cyan couplers
C-7.
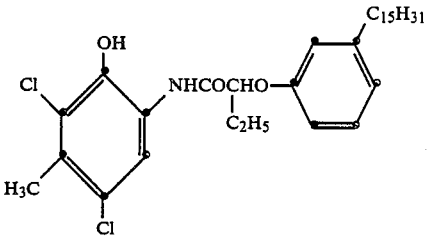
Magenta couplers
M-1.
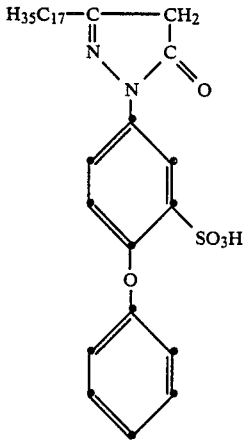
M-2.
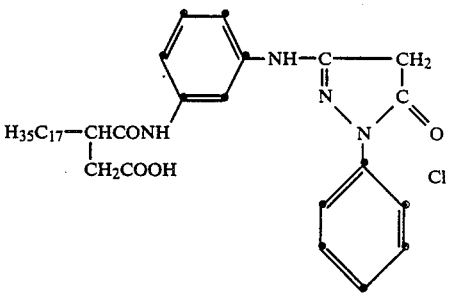
M-3.
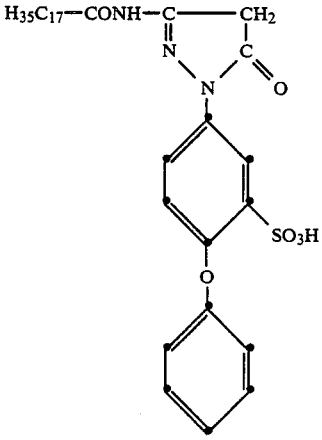

-continued
Magenta couplers
M-4.
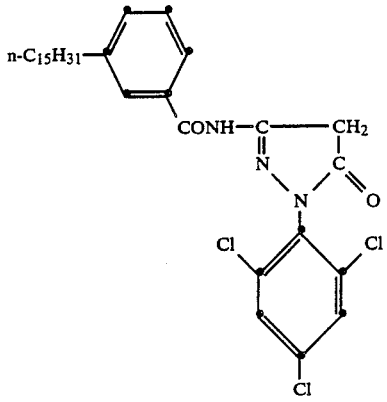
M-5.
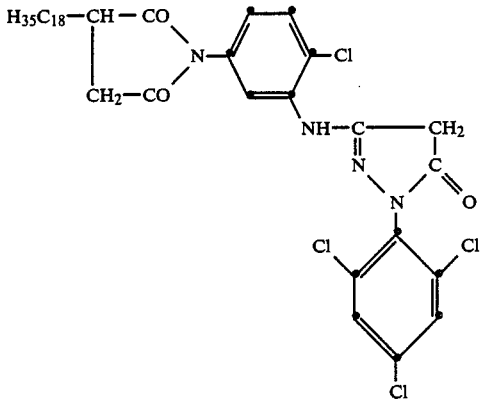
M-6.
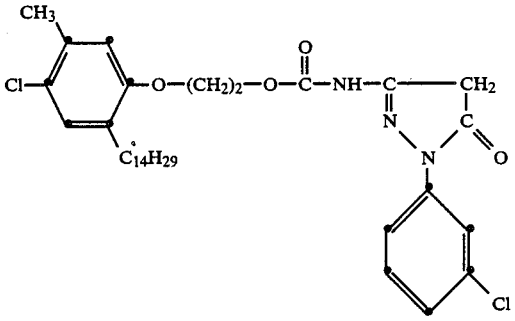
M-7.
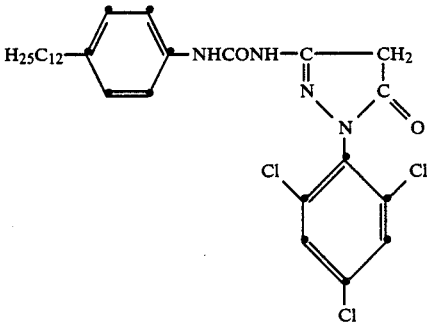
-continued
Magenta couplers
M-8.
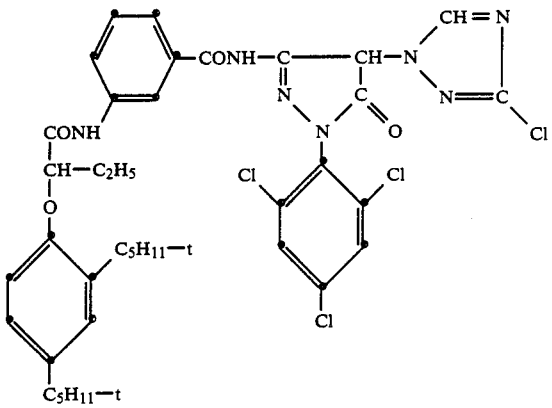
Examples of couplers having a low coupling rate comprise the following compounds.
Cyan couplers
C-8.
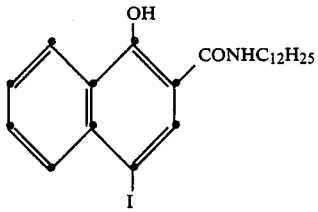
C-9.
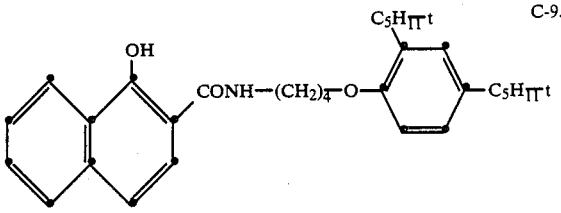
C-10.
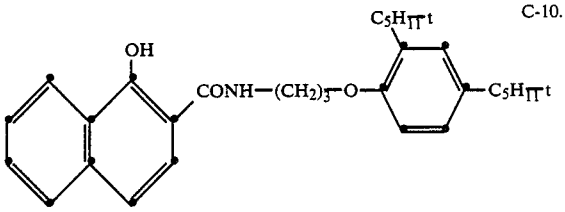

-continued

Cyan couplers

C-11.

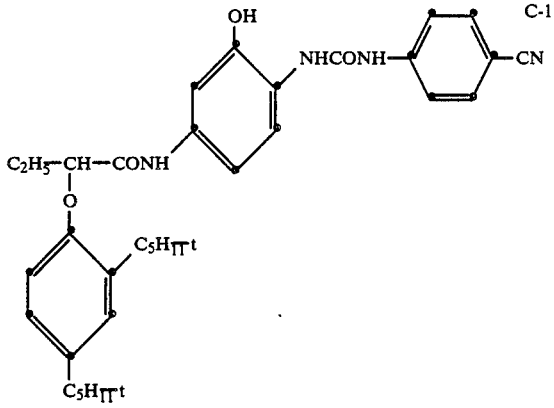

Magenta couplers

M-9.

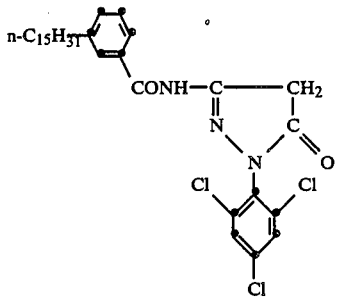

M-10.

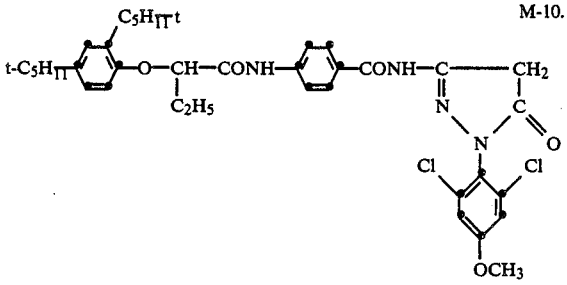

M-11.

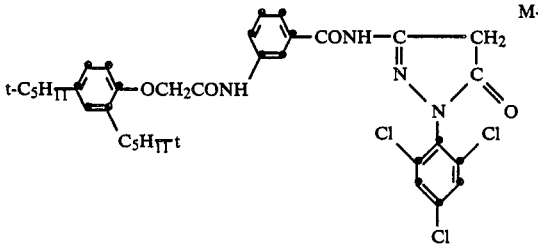

M-12.

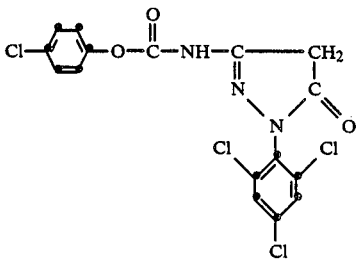

-continued

Magenta couplers

M-13

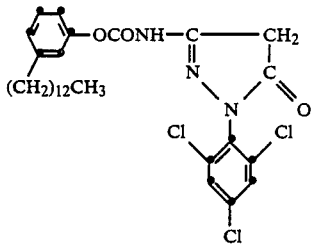

In order to determine relative coupling rates of water-insoluble couplers an easy method can be derived from that described in European Patent Application Ser. No. 107,112. According to this method, the relative coupling rate of a coupler is determined with reference to a standard coupler forming a different dye. The coupler, whose coupling rate is to be determined, is mixed with the standard coupler, the mixture is introduced into a silver halide emulsion layer, the layer is exposed and processed by color development to form a color image. The amounts of each dye are measured and the coupling rate is measured as a relative value (really as a coupling ratio).

The following is a detailed description of the method to determine relative coupling rates.

A standard silver halide emulsion blend is prepared comprising 35% by weight of a AgBrI emulsion (having 9.4% AgI moles, average grain size of 0.23 micron and a silver/gelatin ratio of 1.13) and 65% by weight of a AgBrClI emulsion (having 7.2% AgI moles, 5.2% AgCl moles, average grain size of 0.48 micron and silver/gelatin ratio of 1.13).

Dispersions of a mixture of a standard coupler and a coupler, whose relative coupling rate is to be determined, are obtained by dissolving the two couplers in a high boiling organic solvent in the presence of an auxiliary low-boiling organic solvent and dispersing the solution in an aqueous gelatin solution in the presence of a surface active agent with an homogenizer.

Grams 100 of each dispersion contain:

| | | |
|---|---|---|
| Coupler A (standard) | mmoles | 4.46 · n/4 |
| Coupler B (test) | " | 4.46 · n/4 |
| Tricresylphosphate | ml | 10 |
| Ethylacetate | " | 10 |
| Aqueous gelatin (10% w/w) | g | 32 |
| Hostapur TM SAS (1% w/w) | ml | 5 |
| Water to make | g | 100 |

wherein n is the silver equivalents of the coupler.

Grams 150 of each dispersion are added to 100 g of the emulsion blend to get 60.n/4 mmoles/mole Ag of Coupler A and 60.n/4 mmoles/mole Ag of Coupler B. Each mixture is added with conventional antifogging agents and surface active agents. Each mixture is coated on a subbed cellulose triacetate support base to form a photographic film. Onto each film a protective coating of gelatin containing a conventional hardener is coated.

Each film is exposed through a continuous wedge to a light source having a color temperature of 5,500° K. and processed in a standard Kodak Flexicolor chemistry as described in British Journal of Photography, July 12, 1974, pages 597–598.

Since Couplers A and B give dyes with different light absorption (that is when Coupler B is a magenta coupler, its standard Coupler A is a cyan coupler and vice-versa), each developed film is read at red and green light and optical densities at speed point 0.20 log E ($OD_{1A}$ and $OD_{1B}$) and at point 0.20+1 log E ($OD_{2A}$ and $OD_{2B}$) are measured.

The coupling ratio was determined by the following equation:

$$R\frac{B}{A} = \frac{\lg(1 - OD1B/OD2B)}{\lg(1 - OD1A/OD2A)}$$

The following Table 1 reports the relative coupling ratios of the couplers according to this invention.

TABLE 1

| Standard Coupler A | Test Coupler B | Coupling ratios |
|---|---|---|
| C-9 | M-11 | 1.40 |
| C-9 | M-7 | 1.60 |
| C-9 | M-8 | 1.69 |
| M-11 | C-9 | 0.77 |
| M-11 | C-7 | 1.16 |
| M-11 | C-11 | 0.53 |

The measured coupling ratios of various Couplers B with reference to a Standard Coupler A can be used as relative coupling rates of the considered couplers.

When choosing higher and lower coupling rate couplers to practice the present invention, the skilled in the art can make reference to the traditional classification which distinguishes couplers in two classes respectively having high and low coupling rates, as already described. However, according to the present invention, it is not essential to make reference to such two classes whose determination is based on measurements of absolute coupling rate values. It is sufficient and more practical, to the purposes of the invention, to choose the couplers on the basis of their relative coupling rates as indicated hereinabove. The skilled in the art will be able to choose the couplers on the basis of their differences in relative coupling rates independently from their being within a predetermined class. Preferably, by making reference to the relative method above, the difference of relative coupling rates (measured as coupling ratios with reference to the same standard coupler) between a coupler having a higher relative coupling rate and a coupler (forming the same color) having a lower relative coupling rate is to be at least 0.1, more preferably at least 0.2

The proportions of the constituents in the upper (most sensitive) and intermediate (medium sensitivity) red-sensitive silver halide emulsion layers and in the upper (more sensitive) green-sensitive silver halide emulsion layer should be selected so as to obtain a lower color density, on color development, in these layers than in the lower (least sensitive) red-sensitive and in the lower (less sensitive) green-sensitive silver halide emulsion layers, respectively. This is preferably achieved by altering the silver to coupler ratio. The amount of coupler in the upper and intermediate red-sensitive layers and in the upper green-sensitive layer is preferably reduced so that the molar ratio of the silver halide to coupler is 20:1 to 150:1, and preferably 40:1 to 120:1, by which the maximum color density of the image ranges from 0.6 to 0.1 in each layer, while the silver halide to coupler molar ratios in the lower red-sensitive and green-sensitive layers is 2:1 to 5:1. The amount of silver used in each emulsion layer is from 0.1 to 5 grams per square meter. If a development inhibitor compound (DIR-coupler and/or compound as described above) is incorporated in the lower red-sensitive or (preferably) in the lower green-sensitive layer, this is used in amounts of 0.1 to 10%, preferably 0.05 to 5% per mole of said coupler to the total moles of coupler in each emulsion layer.

In the multilayer color photographic material according to the invention, two or more blue-sensitive silver halide emulsion layers, arranged adjacently one to the other, may also be present in known manner, instead of a single blue-sensitive silver halide emulsion layer, sensitive to the visible light in the same spectral wavelength range, with the sensitivity of the layers decreasing in the order from the upper (more sensitive) to the lower (less sensitive) layer. Preferably, the sensitivity difference between the upper and the lower layer is 0.15 to 1.3 logE and, like the density differences in the red-sensitive and green-sensitive silver halide emulsion layers, is selected so as to obtain a linear gradation curve on development. The blue-sensitive silver halide emulsion layer contains at least one diffusion-resistant color coupler for producing the yellow color image, generally a color coupler containing an open-chain ketomethylene group. Suitable yellow dye-forming couplers, which can be used in the present invention, can be selected from those yellow couplers described in U.S. Pat. Nos. 3,265,506; 3,728,658; 3,369,895; 3,582,322; 3,408,194; 3,415,652 and 3,235,924; in German patent application Ser. Nos. 1,956,281; 2,162,899 and 2,213,461 and in British Pat. Nos. 1,286,411; 1,040,710; 1,302,398; 1,204,680 and 1,421,123.

The silver halide emulsion used in this invention may be a fine dispersion of silver chloride, silver bromide, silver chloro-bromide, silver iodo-bromide and silver chloro-iodo-bromide in a hydrophilic binder. As hydrophilic binder, any hydrophilic polymer of those conventionally used in photography can be advantageously employed including gelatin, a gelatin derivative such as an acylated gelatin, a graft gelatin, etc., albumin, gum arabic, agar agar, a cellulose derivative, such as hydroxyethyl cellulose, carboxymethyl cellulose, etc., a synthetic resin, such as polyvinyl alcohol, polyvinyl pyrrolidone, polyacrylamide, etc. Preferred silver halides are silver iodo-bromide or silver iodo-bromo-chloride containing 1 to 12% mole silver iodide. The silver halide grains may have any crystal form such as cubical, octahedral, tabular or a mixed crystal form. The silver halide can have a uniform grain size or a broad grain size distribution. The size of the silver halide ranges from about 0.1 to about 3 microns. The silver halide emulsion can be prepared using a single-jet method, a double-jet method, or a combination of these methods or can be matured using, for instance, an ammonia method, a neutralization method, an acid method, etc.

The emulsions which can be used in the present invention can be chemically and optically sensitized as described in Research Disclosure No. 17643, III and IV, December 1978; they can contain optical brighteners, antifogging agents and stabilizers, filtering and antihalo dyes, hardeners, coating aids, plasticizers and lubricants and other auxiliary substances, as for instance described in Research Disclosure 17643, V, VI, VIII, X, XI and XII, December 1978.

The layers of the photographic emulsion and the layers of the photographic element can contain various colloids, alone or in combination, such as binding materials, as for instance described in Research Disclosure No. 17643, IX, December 1978.

The above described emulsions can be coated onto several support bases (cellulose triacetate, paper, resin-coated paper, polyester included) by adopting various methods, as described in Research Disclosure No. 17643, XV and XVII, December 1978.

The light-sensitive silver halide contained in the photographic elements of the present invention after exposure can be processed to form a visible image by associating the silver halide with an aqueous alkaline medium in the presence of a developing agent contained in the medium or in the element. Processing formulations and techniques are described in Research Disclosure No. 17643, XIX, XX and XXI, December 1978.

The present invention is now described with more details by making reference to the following examples, wherein, in addition to the couplers described hereinafter, the following couplers have been used:

A.

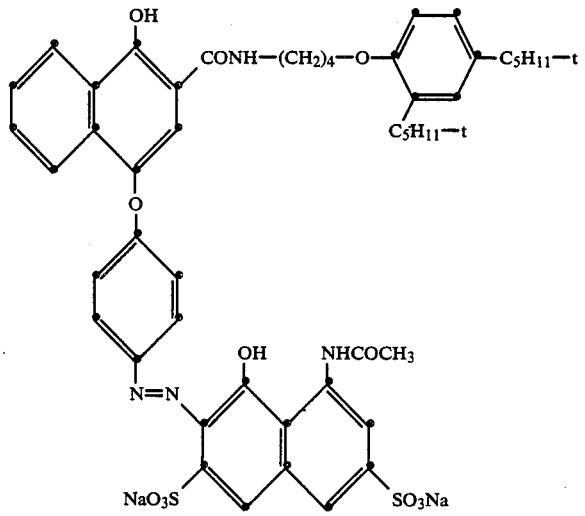

B.

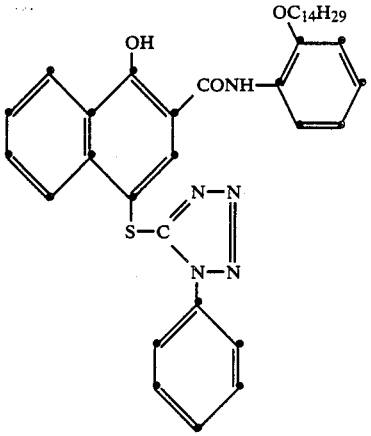

D.

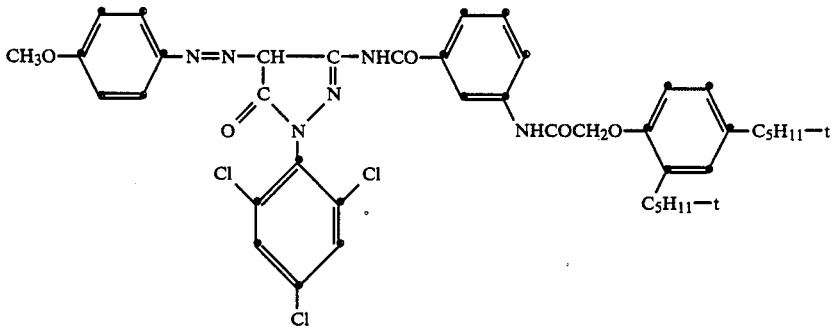

E.

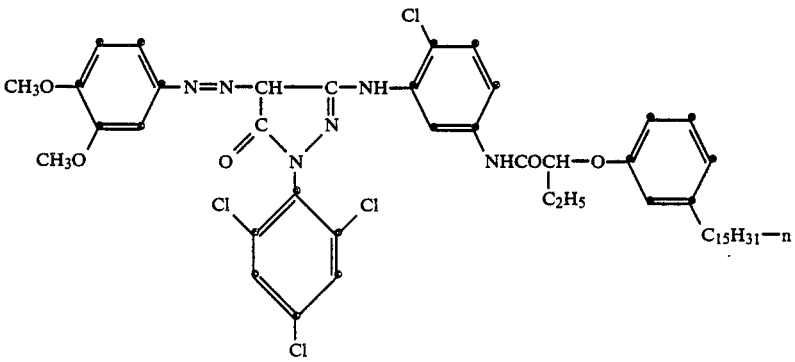

-continued

F.

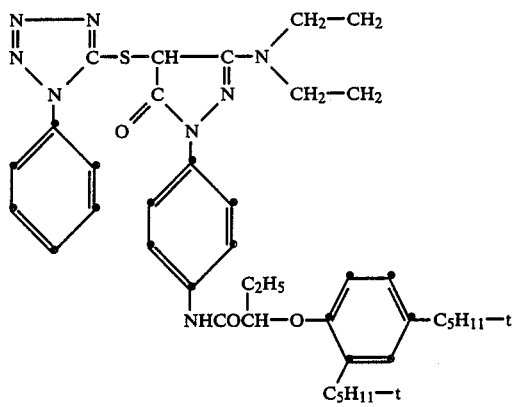

G.

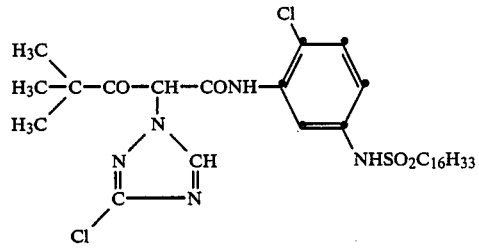

EXAMPLE 1

A control multilayer negative color film (Film 1A) was made by coating a subbed cellulose triacetate support with the following layers in the indicated order:

Layer 1: Antihalation gelatin layer;

Layer 2: Interlayer containing 1.2 g/m$^2$ of gelatin;

Layer 3: Least sensitive red-sensitive cyan-dye forming silver halide emulsion layer comprising a blend of a slow speed red-sensitive silver bromoiodo-chloride emulsion (having 88% mole bromide, 7% mole iodide and 5% mole chloride, a mean diameter of 0.4μ and representing 75% of the blend) and a medium speed red-sensitive silver bromo-iodide emulsion (having 93% mole bromide and 7% mole chloride, mean diameter of 0.75μ and representing 25% of the blend), coated at a total silver coverage of 1.64 g/m$^2$, 121 mg/m$^2$ of the magenta colored cyan-dye forming coupler A, 325 g/m$^2$ of the 4-equivalent cyan-dye forming coupler C-9, 5.5 mg/m$^2$ of the cyan dye-forming DIR coupler B and 1.54 g/m$^2$ of gelatin;

Layer 4: Most sensitive red-sensitive cyan dye-forming silver halide emulsion layer comprising a fast red-sensitive silver bromo-iodide emulsion (having 93% mole bromide and 7% mole iodide and mean diameter of 1.1μ) coated at a silver coverage of 1.9 g/m$^2$, 62 mg/m$^2$ of the 4-equivalent cyan dye-forming coupler C-9, 62 g/m$^2$ of the 2-equivalent cyan dye-forming coupler C-7 and 1.5 g/m$^2$ of gelatin;

Layer 5: Interlayer containing a fine-grain Lippmann silver bromo-iodide emulsion (having (98% mole bromide, 2% mole iodide and mean diameter of 0.09μ) coated at a silver coverage of 0.24 g/m$^2$ and 1.16 g/m$^2$ of gelatin;

Layer 6: Less sensitive green-sensitive magenta forming silver halide emulsion layer comprising a slow green-sensitive silver bromo-iodo-chloride emulsion (having 88% mole bromide, 7% mole iodide and 5% mole chloride and a mean diameter of 0.4μ) coated at a silver coverage of 2.2 g/m$^2$, 35 g/m$^2$ of the yellow colored magenta forming coupler D, 175 mg/m$^2$ of the yellow colored magenta forming coupler E, 384 mg/m$^2$ of the 4-equivalent magenta forming coupler M-11, 50 mg/m$^2$ of the magenta forming DIR coupler F and 2.3 g/m$^2$ of gelatin.

Layer 7: More sensitive green-sensitive magenta forming silver halide emulsion layer comprising a fast green-sensitive silver bromo-iodide emulsion (having 93% mole bromide and 7% mole iodide and mean diameter of 1.13μ) coated at a silver coverage of 2.3 g/m$^2$, 248 g/m$^2$ of the 4-equivalent magenta forming coupler M-11 and 1.85 g/m$^2$ of gelatin;

Layer 8: Interlayer containing 0.79 g/m$^2$ of gelatin;

Layer 9: Yellow colloidal silver filter layer comprising 0.019 g/m$^2$ of silver and 0.69 g/m$^2$ of gelatin;

Layer 10: Less sensitive blue-sensitive yellow dye forming silver halide emulsion layer comprising a blend of a slow blue-sensitive silver bromo-iodo-chloride emulsion (having 88% mole bromide, 7% mole iodide and 5% mole chloride, mean diameter of 0.4μ and representing 50% of the blend) and a still slower blue-sensitive silver bromo-iodide emulsion (having 97.5% mole bromide and 2.5% mole iodide, mean diameter of 0.23μ and representing 50% of the blend) coated at a total silver coverage of 0.74 g/m$^2$, 1.5 g/m$^2$ of the 2-equivalent yellow forming coupler G and 2.15 g/m$^2$ of gelatin;

Layer 11: More sensitive blue-sensitive yellow dye forming silver halide emulsion layer comprising a blue-sensitive silver bromo-iodide emulsion (having 93% mole bromide and 7% mole iodide and a mean diameter of 1.1μ) coated at a silver coverage of 1.28 g/m$^2$, 333 mg/m$^2$ of the 2-equivalent yellow forming coupler G and 1.50 g/m$^2$ of gelatin;

Layer 12: Interlayer containing 1.40 g/m$^2$ of gelatin;

Layer 13: Protective gelatin overcoat comprising 0.77 g/m$^2$ of gelatin.

A multilayer negative color film (Film 1B) according to the present invention was made by coating the subbed cellulose triacetate support with the following layers in the indicated order:

Layer 1: Antihalation gelatin layer (Layer 1 of Film 1A);

Layer 2: Interlayer containing gelatin (Layer 2 of Film 1A);

Layer 3: Least sensitive cyan dye forming silver halide emulsion layer (Layer 3 of Film 1A lacking in the cyan dye forming DIR coupler B);

Layer 4: Medium sensitivity red-sensitive cyan dye forming silver halide emulsion layer (Layer 4 of Film 1A);

Layer 5: Interlayer containing 1.23 g/m$^2$ of gelatin;

Layer 6: Less sensitive green-sensitive magenta dye forming silver halide emulsion layer comprising a blend of a slow green-sensitive silver bromo-iodo-chloride emulsion (Having 88% mole bromide, 7% mole iodide and 5% mole chloride, mean diameter of 0.4μ and respresenting 75% of the blend) and a medium speed green-sensitive silver bromo-iodide emulsion (having 93% mole bromide and 7% mole iodide, mean diameter of 0.75μ and representing 25% of the blend), coated at a total silver coverage of 2.2 g/m², 35 mg/m² of the yellow colored magenta dye forming coupler D, 175 mg/m² of the yellow colored magenta dye forming coupler E, 380 mg/m² of the 4-equivalent magenta dye forming coupler M-11, 40 mg/m² of the magenta dye forming DIR coupler F and 2.3 g/m² of gelatin;

Layer 7: Interlayer containing 0.79 mg/m² of gelatin;

Layer 8: Most sensitive red-sensitive cyan dye forming silver halide layer comprising a fast red-sensitive silver bromo-iodide emulsion (having 93% mole bromide and 7% mole iodide and mean diameter of 1.1μ), coated at a silver coverage of 1.9 g/m², 138 mg/m² of the 2-equivalent cyan dye forming coupler C-7 and 1.5 g/m² of gelatin;

Layer 9: Interlayer containing a fine-grain Lippmann silver bromo-iodide emulsion (having 98% mole bromide, 2% mole iodide and mean diameter of 0.09μ), coated at a silver coverage of 0.24 g/m² and 1.16 g/m² of gelatin;

Layer 10: More sensitive green-sensitive magenta dye forming silver halide emulsion layer comprising a fast green-sensitive silver bromo-iodide emulsion (having 93% mole bromide and 7% mole iodide and mean diameter of 1.1μ), coated at a silver coverage of 2.3 g/m², 199 mg/m² *of the* 4-equivalent magenta dye forming coupler M-7 and 1.85 g/m² of gelatin;

Layer 11: Interlayer containing gelatin (Layer 8 of Film 1A);

Layer 12: Yellow colloidal silver filter layer comprising 0.006 g/m² of silver and 0.69 g/m² of gelatin;

Layer 13: Less sensitive blue-sensitive yellow dye forming silver halide emulsion layer (Layer 10 of Film 1A);

Layer 14: More sensitive blue-sensitive yellow dye forming silver halide emulsion layer (Layer 11 of Film 1A);

Layer 15: Interlayer containing gelatin (Layer 12 of Film 1A);

Layer 16: Protective gelatin overcoat (Layer 13 of Film 1A).

A multilayer negative color film (Film 1C) according to the present invention was made by coating a subbed cellulose triacetate support with the same layers of Film 1B, with the only difference that Layer 7 was an interlayer containing a fine-grain Lippmann silver bromo-iodide emulsion (having 98% mole bromide and 2% mole iodide and a mean diameter of 0.09μ), coated at a silver coverage of 0.24 g/m² and 1.16 g/m² of gelatin.

The films were exposed on a sensitometer through a continuous wedge to a light source having a color temperature of 5,500° K. and processed using Kodak Flexicolor process which is described in the British Journal of Photography, July 12, 1974, pages 597 to 598. The relative speed (logE) at 0.2 and 1.0 above minimum density (fog) of the "red", "green" and "blue" layers are tabulated below.

TABLE 2

| Film | Layers | Speed (Rel. logE at 0.2 above fog) | Speed (Rel. logE at 1 above fog) |
|---|---|---|---|
| 1A | Red | 20.03 | 7.8 |
| (Control) | Green | 24.5 | 13.7 |
| | Blue | 25.9 | 18.2 |
| 1B | Red | 25.3 | 11.4 |
| (Invention) | Green | 26.1 | 17.1 |
| | Blue | 26.6 | 19.7 |

TABLE 2-continued

| Film | Layers | Speed (Rel. logE at 0.2 above fog) | Speed (Rel. logE at 1 above fog) |
|---|---|---|---|
| 1C | Red | 24.5 | 11.2 |
| (Invention) | Green | 25.7 | 15.6 |
| | Blue | 26.7 | 19.9 |

EXAMPLE 2

Another control multilayer negative color film (Film 2A) was made having the same structure of Film 1A of Example 1.

A multilayer negative color film (Film 2B) according to the present invention was made by coating a subbed cellulose triacetate support with the following layers in the indicated order:

Layer 1: Antihalation gelatin layer (Layer 1 of Film 1B);

Layer 2: Interlayer containing gelatin (Layer 2 of Film 1B);

Layer 3: Least sensitive red-sensitive cyan dye forming silver halide emulsion layer (Layer 3 of Film 1B);

Layer 4: Medium sensitivity red-sensitive cyan dye forming silver halide emulsion layer (Layer 4 of Film 1B);

Layer 5: Interlayer containing gelatin (Layer 5 of Film 1B);

Layer 6: Less sensitive green-sensitive magenta dye forming silver halide emulsion layer (Layer 6 of Film 1B);

Layer 7: Interlayer containing gelatin (Layer 7 of Film 1B);

Layer 8: Most sensitive red-sensitive cyan dye forming silver halide layer (Layer 8 of Film 2B);

Layer 9: Interlayer containing the fine-grain Lippmann silver bromo-iodide emulsion (Layer 9 of Film 2B);

Layer 10: More sensitive green-sensitive magenta dye forming silver halide layer (Layer 10 of Film 2B);

Layer 11: Interlayer containing gelatin (Layer 11 of Film 2B);

Layer 12: Yellow colloidal silver filter layer (Layer 12 of Film 2B);

Layer 13: Less sensitive blue-sensitive yellow dye forming silver halide emulsion layer (Layer 13 of Film 2B);

Layer 14: More sensitive blue-sensitive yellow dye forming silver halide emulsion layer comprising a fast blue-sensitive silver bromide emulsion (having 86% mole bromide, 14% mole iodide and mean diameter of 1.35μ), coated at a silver coverage of 1.3 g/m², 330 mg/m² of the 2-equivalent yellow forming coupler G and 1.50 g/m² gelatin;

Layer 15: Interlayer containing the fine-grain Lippmann silver bromo-iodide emulsion (having 98% mole bromide, 2% mole iodide and mean diameter of 0.09μ), coated at a silver coverage of 0.24 g/m² and 1.15 g/m² of gelatin;

Layer 16: Protective gelatin overcoat (Layer 16 of Film 2B).

The films were exposed and processed as described in Example 1. The relative speed (logE) at 0.2 above minimum density of the "red" and "green" layers are tabulated below.

TABLE 3

| Film | Layers | Speed (Rel. logE at 0.2 above fog) |
|---|---|---|
| 2A | Red | 21.4 |
| (Control) | Green | 24.9 |
| 2B | Red | 25.8 |
| (Invention) | Green | 27.2 |

I claim:

1. A multilayer color photographic material comprising a support having coated thereon a plurality of light-sensitive and non-light-sensitive layers including:

(a) at least three red-sensitive silver halide emulsion layers, the sensitivity of the at least three layers increasing in order from the lower layer to the upper layer;

(b) at least two green-sensitive silver halide emulsion layers, the sensitivity of said at least two layers increasing in order from the lower layer to the upper layer; and (c) at least one blue-sensitive silver halide emulsion layer, said silver halide emulsion layers being associated with non-diffusing image-forming couplers, characterized in that the most sensitive red-sensitive silver halide emulsion layer is arranged between the less sensitive and the more sensitive green-sensitive silver halide emulsion layers, the most sensitive red-sensitive silver halide emulsion layer contains at least one non-diffusing cyan coupler and the more sensitive green-sensitive silver halide emulsion layer contains at least one non-diffusing magenta coupler, said cyan and magenta couplers having relative coupling rates higher than couplers forming the same color in the respective layers of lower same-wavelength sensitivity.

2. A multilayer color photographic material as claimed in claim 1, wherein the relative coupling rate difference between couplers having higher coupling rates and couplers forming the same color with lower coupling rates is at least 0.1.

3. A multilayer photographic material as claimed in claim 1, wherein the following layers are applied in the following order on the support:

(a) at least sensitive red-sensitive silver halide emulsion layer containing a cyan coupler;

(b) a medium sensitivity red-sensitive silver halide emulsion layer containing a cyan coupler;

(c) a less sensitive green-sensitive silver halide emulsion layer containing a magenta coupler;

(d) a most sensitive red-sensitive silver halide emulsion layer containing a cyan coupler;

(e) a more sensitive green-sensitive silver halide emulsion layer containing a magenta coupler;

(f) a yellow filter layer;

(g) a less sensitive blue-sensitive silver halide emulsion layer containing a yellow coupler;

(h) a more sensitive blue-sensitive silver halide emulsion layer containing a yellow coupler.

4. A multilayer color photographic material as claimed in claim 1 wherein the difference in effective speed of the most sensitive red-sensitive and the medium sensitivity red-sensitive silver halide emulsion layers is from 0.15 to 1.3 relative logE units.

5. A multilayer color photographic material as claimed in claim 1, wherein the difference in effective speed of the more sensitive and the less sensitive green-sensitive silver halide emulsion layers is from 0.15 to 1.3 relative logE units.

6. A multilayer color photographic material as claimed in claim 1, wherein the most sensitive red-sensitive silver halide emulsion layer has a coupler to silver ratio lower than that of the least sensitive red-sensitive silver halide emulsion layer.

7. A color photographic material as claimed in claim 1, wherein the less sensitive green-sensitive silver halide emulsion layer contains a development inhibitor-releasing (DIR) coupler and/or compound.

8. A multilayer color photographic material as claimed in claim 7, wherein the DIR coupler and/or compound is comprised in any amount of from 0.05 to 5% moles to the total moles of coupler in the layer.

9. A multilayer color photographic material as claimed in claim 1, wherein a non-light-sensitive silver halide emulsion layer is comprised between the most sensitive red-sensitive silver halide emulsion layer and the more sensitive green-sensitive silver halide emulsion layer, said non-light-sensitive layer comprising substantially non-light-sensitive silver halide grains.

10. A multilayer color photographic material comprising a support having coated thereon a plurality of light-sensitive and non-light-sensitive layers including:

(a) at least three red-sensitive silver halide emulsion layers, the sensitivity of the at least three layers increasing in order from the lower layer to the upper layer;

(b) at least two green-sensitive silver halide emulsion layers, the sensitivity of said at least two layers increasing in order from the lower layer to the upper layer; and (c) at least one blue-sensitive silver halide emulsion layer, said silver halide emulsion layers being associated with non-diffusing image-forming couplers, characterized in that the most sensitive red-sensitive silver halide emulsion layer is arranged between the less sensitive and the more sensitive green-sensitive halide emulsion layers, the most sensitive red-sensitive silver halide emulsion layer contains at least one non-diffusing cyan coupler and the more sensitive green-sensitive silver halide emulsion layer contains at least one non-diffusing magenta coupler, said cyan and magenta couplers having relative coupling rates 2 to 20 times higher than the different couplers forming the same color in the respective layers of lower same-wavelength sensitivity.

11. A multilayer photographic material as claimed in claim 1, wherein the following layers are applied in the following order on the support:

(a) a least sensitive red-sensitive silver halide emulsion layer containing a cyan coupler;

(b) a medium sensitivity red-sensitive silver halide emulsion layer containing a cyan coupler;

(c) a less sensitive green-sensitive silver halide emulsion layer containing a magenta coupler;

(d) a most sensitive red-sensitive silver halide emulsion layer containing a cyan coupler;

(e) a more sensitive green-sensitive silver halide emulsion layer containing a magenta coupler;

(f) a yellow filter layer;

(g) a less sensitive blue-sensitive silver halide emulsion layer containing a yellow coupler;

(h) a more sensitive blue sensitive silver halide emulsion layer containing a yellow coupler.

12. A multilayer color photographic material as claimed in claim 10 wherein the difference in effective speed of the most sensitive red-sensitive and the medium sensitivity red-sensitive silver halide emulsion layers is from 0.15 to 1.3 relative logE units.

13. A multilayer color photographic material as claimed in claim 10, wherein the difference in effective speed of the more sensitive and the less sensitive green-sensitive silver halide emulsion layers is from 0.15 to 1.3 relative logE units.

14. A multilayer color photographic material as claimed in claim 10, wherein the most sensitive red-sensitive silver halide emulsion layer has a coupler to silver ratio lower than that of the least sensitive red-sensitive silver halide emulsion layer.

15. A color photographic material as claimed in claim 10, wherein the less sensitive green-sensitive silver halide emulsion layer contains a development inhibitor-releasing (DIR) coupler and/or compound.

16. A multilayer color photographic material as claimed in claim 15, wherein the DIR coupler and/or compound is comprised in any amount of from 0.05 to 5% moles to the total moles of coupler in the layer.

17. A multilayer color photographic material as claimed in claim 10, wherein a non-light-sensitive silver halide emulsion layer is between the most sensitive red-sensitive silver halide emulsion layer, said non-light-sensitive layer comprising substantially non-light-sensitive silver halide grains.

18. The material of claim 10 wherein the ratio of coupling rates of said cyan couplers is between 3 and 5.

19. The material of claim 10 wherein the ratio of coupling rates of said magenta couplers is between 3 and 5.

20. The material of claim 19 wherein the ratio of coupling rates of said cyan couplers is between 3 and 5.

* * * * *